US006342690B1

(12) United States Patent
O'Donnell

(10) Patent No.: US 6,342,690 B1
(45) Date of Patent: Jan. 29, 2002

(54) GLOW PLUG ASSEMBLY METHOD AND CONSTRUCTION

(76) Inventor: Steven B. O'Donnell, 11435 Eberle Cir., Cerritos, CA (US) 90703

( * ) Notice: Subject to any disclaimer, the term of this patent is extended or adjusted under 35 U.S.C. 154(b) by 0 days.

(21) Appl. No.: 09/727,260

(22) Filed: Dec. 1, 2000

(51) Int. Cl.[7] ..... F23Q 7/22
(52) U.S. Cl. ..... 219/270; 123/145 A; 29/611
(58) Field of Search ..... 219/270, 544; 123/145 A, 145 R; 29/611

(56) References Cited

U.S. PATENT DOCUMENTS 2,482,831 A 9/1949 Arden
5,589,091 A * 12/1996 Muller ..... 219/270
6,062,185 A 5/2000 Chiu et al.
6,144,015 A * 11/2000 Chiu et al. ..... 219/270
6,248,980 B1 * 6/2001 Chiu et al. ..... 219/270

* cited by examiner

*Primary Examiner*—John A. Jeffery
(74) *Attorney, Agent, or Firm*—Edgar W. Averill, Jr.

(57) ABSTRACT

A glow plug assembly method and construction providing a partially assembled glow plug construction having a core body positioned in a hollow plug body with insulating support elements preventing contact between the core body and the plug body. Furthermore, a bolt fastener having a head portion and a threaded shank portion is threadedly secured into the open upper end of the hollow plug body such that a flange portion of the rod-like stud, as well as the insulating support members, are clamped together in a sealing manner.

6 Claims, 1 Drawing Sheet

GLOW PLUG ASSEMBLY METHOD AND CONSTRUCTION

BACKGROUND OF THE INVENTION

The field of the invention generally pertains to ignition devices for use with internal combustion engines. The invention relates more particularly to a glow plug assembly method and construction utilizing a bolt fastener to threadedly clamp a core body within a plug body in a sealing manner, with an upper portion of the bolt fastener subsequently truncated to produce a truncated portion left remaining in the plug body.

It is known for diesel and other spark-less internal combustion engines, such as those used for miniature radio-controlled models, to utilize a preheating device whereby the temperature is raised sufficiently to ignite a pressurized combustion chamber and initiate the engine cycle. Due to the high temperatures and pressures necessary for proper operation for these types of engines, it is critical that such preheating devices, commonly known as "glow plugs," are adequately sealed to prevent pressure leakage therethrough. Oftentimes, however, leakage may occur through the electrically insulating seals separating two electrodes which provide electricity to a heating element of the glow plug. This can cause the engine to run lean and can cause damage to the engine.

To this end, various methods have been developed for internally sealing glow plugs. In most of these methods, a washer or nut is used as an intermediary element by which a pressure is exerted against the internal seals to prevent leakage therethrough. For example, a crimping method is commonly used with washers such that a crimp portion exerts a retaining crimp force against the washer for maintaining a seal. However, one problem with the crimping process has been the inability to provide the proper amount of force necessary to produce a crimp which is capable of consistently exerting a retaining force and pressure on a washer whereby the glow plug may be sealably maintained. Moreover, even with a proper crimp formation, the crimp may experience some yielding over time and repeated use which may reduce the crimp and sealing pressures inside the glow plug.

Alternatively, various glow plug configurations have utilized an externally threaded nut to provide the downward retaining and sealing forces. For example, in U.S. Pat. No. 2,482,831, an ignition plug is shown utilizing an externally threaded nut 18 threadedly secured within a plug body to exert a compression force against sealing elements 16 and 17, and by which a flange 15 is clamped down. While the exact manner in which the nut 18 is threadedly secured is not disclosed, FIG. 2 of the drawings appears to indicate a groove along the upper surface of the nut 18 by which the nut is torqued into the plug body. Nut 18, however, requires a specially designed tool, such as a modified screwdriver having a central bore to effect the threaded engagement.

Also, in U.S. Pat. No. 6,062,185, a glow sensor is shown incorporating a tubular nut 36 connected to a hexagonal outer end 38. The hexagonal outer end 38 is utilized to threadedly secure the nut 36 into the outer portion of a bore. Unfortunately, however, the presence of the hexagonal outer end 38 in the final configuration of the glow sensor while useful in securing the nut 36 into the bore, prevents a crimp from being applied to the nut. An example of such crimping is shown in U.S. Pat. No. 4,425,692 showing a glow plug having a crimp portion 35 which causes buckling of a metal pipe 30.

Thus, it would be advantageous to provide a sealing pressure on the internal seals of a glow plug by utilizing an externally threaded nut which may be suitably torqued, but which is not limited or restricted by the presence of a head portion utilized in securing the externally threaded nut. The absence of an upper part of the threaded nut, including the head portion, would enable the application of additional securing measures, such as a crimp.

BRIEF SUMMARY OF THE INVENTION

It is an object of the present invention to provide a glow plug assembly method and construction for internally pressure sealing the glow plug to prevent pressure leakage therethrough.

It is a further object of the present invention to provide a glow plug assembly method and construction which utilizes a bolt-like fastener having a head portion and a threaded shank portion, wherein substantial contact and sealing pressure may be exerted against a retained element by torquing the head portion of the bolt-like fastener.

It is a still further object of the present invention to provide a glow plug assembly method and construction wherein the upper part of the bolt-like fastener, including the head portion, is thereafter removed.

The present invention is for a glow plug construction comprising a plug body having an open upper end with an upper rim. The open upper end leads into a plug bore which has a threaded portion at the open upper end and a shelf portion below the threaded portion. The glow plug construction also includes a lower insulating support element which is positioned in the plug bore and seated on the shelf portion. And a core body having a flange portion is positioned in the plug bore and seated on the lower insulating support element. The core body also has a post portion which is connected to the flange portion and which partially protrudes through the open upper end. And an upper insulating support element is positioned in the plug bore and seated on the flange portion. In this manner the core body is spaced from and supported against the plug body by the upper and lower insulating support elements. Additionally, a nut is provided having an externally-threaded sidewall extending between a top surface and an opposing bottom surface, and a nut bore extending through the nut to connect the top and bottom surfaces. The nut is threadedly secured in the open upper end of the plug body such that the post portion of the core body non-tactually extends through the nut bore and the bottom surface abuts against the upper insulating support element. This causes the upper and lower insulating support elements and the flange portion of the core body to be clamped between the bottom surface and the shelf portion. Furthermore, once the nut is threadedly secured in place, the upper rim of the plug body is crimped radially inward over the top surface of the fastener to provide an additional measure of retaining security.

Additionally, the present invention is also for a method of assembling the glow plug construction described above. More particularly, the assembly method concerns the manner by which the nut is threadedly positioned in the plug bore, and ultimately the formation of the nut in its final form. To this end, the assembly method of the glow plug construction provides for a partially assembled glow plug construction similar to that described above, having a core body positioned inside the plug bore of the plug body by means of upper and lower insulating support elements. Additionally, a bolt fastener is also provided having a head portion and a threaded shank connected to the head portion.

The threaded shank is adapted to engage the threaded portion of the plug bore with a top end connected to the head portion and a bottom end having a bottom surface. And a fastener bore extends at least through the threaded shank from the bottom surface. The bolt fastener is threadedly secured in the plug bore by first inserting the post portion of the core body into the fastener bore of the bolt fastener from the bottom end thereof. Next, the head portion of the bolt fastener is rotated to threadedly secure the threaded shank in the plug bore until the bottom surface of the threaded shank abuts against the upper insulating support element. In this manner, the upper and lower insulating support elements, as well as the flange portion of the core body, are securely clamped against the shelf portion. As a final step, the bolt fastener is truncated such that only a truncated portion of the threaded shank remains in the plug bore. Preferably, the bolt fastener is sufficiently truncated to produce a top surface of the truncated portion located below the upper rim of the open upper end. The resulting truncated portion from the truncating step becomes the nut in the final configuration of the glow plug construction. Upon forming the nut from the bolt fastener, the upper rim may be further crimped in a radially inward direction over the top surface of the truncated portion, i.e. nut, to provide an additional security measure to prevent the truncated portion from exiting the plug body.

DESCRIPTION OF THE PREFERRED EMBODIMENTS

Figure 1:
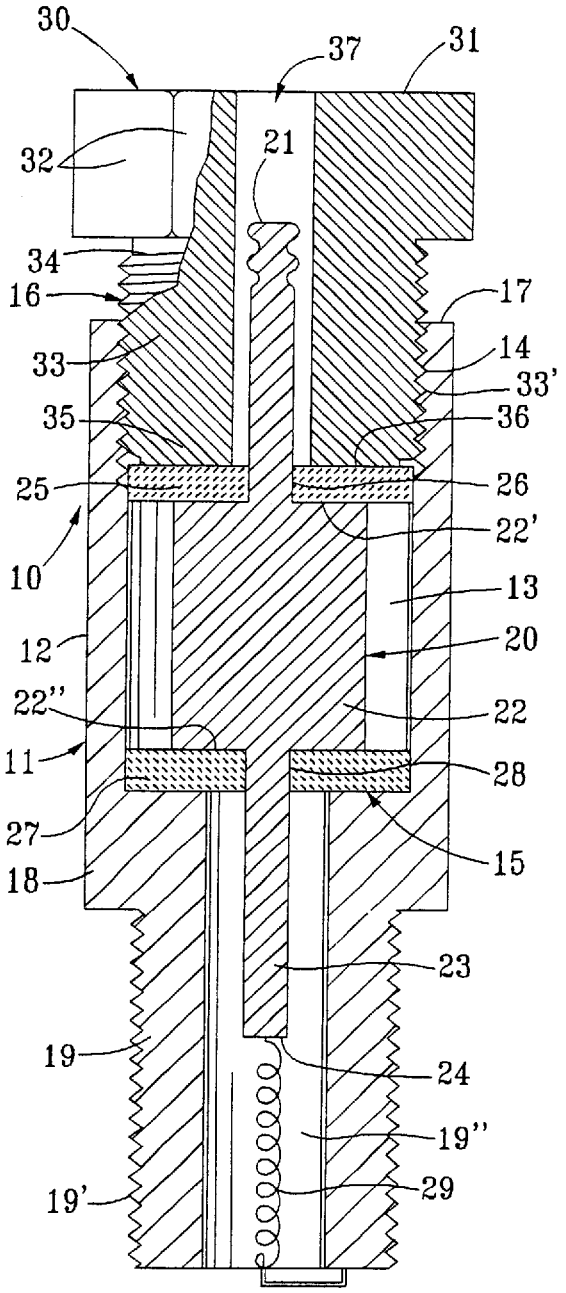
FIG. 1 is a partly cross-sectional view of the glow plug construction with the bolt fastener threadedly secured to the plug body.

Referring now to the drawings, FIG. 1 shows the glow plug construction, generally indicated by reference character 10. FIG. 1 shows a partly cross--sectional view of the entire glow plug construction 10 prior to truncating an upper portion of the bolt fastener 30, as will be discussed in detail below. The glow plug construction 10 comprises a metallic plug body, generally indicated by reference character 11. The plug body 11 has a preferably cylindrical configuration with a side wall 12 surrounding a central plug bore 13, and an open upper end 16 having an upper rim 17. The open upper end 16 leads into the central plug bore 13 which has a threaded surface portion 14 adjacent the open upper end 16. The plug bore 13 also has a shelf portion 15 below the threaded portion 14. As can be seen in FIG. 1, the shelf portion 15 is oriented generally transverse to the cylindrical side wall 12 of the plug body 11 and is an integral part of the plug body 11. Additionally, as can be seen in FIG. 1, the plug body 11 has a lower end 18 and an extension portion 19 extending below the lower end 18. It is notable that while the extension portion 19 shown in FIG. 1 is integrally connected to the lower end 18, other embodiments are also contemplated. For example, the extension portion 19 may be a separate ceramic heater element, known in the relevant art, connected to the plug body 11 at the lower end 18. In any case, the extension portion 19 shown in FIG. 1 functions to surround and protect the heater element 28 as will be discussed in detail below. Furthermore, the extension portion 19 preferably has a threaded surface 19' which functions to threadedly engage an engine block (not shown). This is a conventional way of securing glow plugs to engine blocks. The metallic plug body 11 is preferably composed of an electrically conductive rigid material, such as steel.

As can be seen in FIG. 1, the glow plug construction 10 further comprises a second electrode which is a core body 20 having a generally rod-like configuration. The core body 20 coaxially extends through the open upper end 16 of the plug body 11, i.e. first electrode, and into the plug bore 13 of the plug body 11. The core body 20 has a flange portion 22 positioned within the central plug bore 13 of the plug body 11, an upper post portion 21 connected to and extending above the flange portion 22, beyond the open upper end 16, and a lower post portion 23 connected to and extending below the flange portion 22 partially into a heating area 19" surrounded by the extension portion 19 of the plug body 11. As shown in FIG. 1, the flange portion 22 of the core body 20 preferably has a substantially larger diameter than the upper post portion 21 or the lower post portion 23. The relatively wider diameter of the flange portion 22 provides abutment surfaces 22' and 22" by which the core body 20 is secured within the central plug bore 13 of the plug body 11, as will be discussed next.

As can be seen in FIG. 1, the core body 20 is spaced from and supported against the side wall 12 by an upper insulating support element 25 and a lower insulating support element 27. The lower insulating support element 27 is seated on the shelf portion 15 of the plug bore 13. The lower insulating support element 27 has a central aperture 28 through which the lower post portion 23 of the core body 20 extends. Similarly, an upper insulating support element 25 supports the core body 20 at the upper post portion 21 of the core body 20. Like the lower insulating support element 27, the upper insulating support element 25 has a central aperture 26 through which the upper post portion 21 of the core body 20 extends, and is seated against the upper abutment surface 22' of the flange portion 22. As can be seen in FIG. 1, both the upper and lower insulating support elements 25, 27 space the wider flange portion 22 of the core body 20 from the side wall 12 of the plug body 11. Because both the plug body 11 and the core body 20 are first and second electrodes, they must be at all times separated to prevent short circuiting the system. It is notable that the clearance between the core body 20 and the plug body 11 will depend on the voltage requirements of the glow plug application. For relatively low voltage systems, such as radio-controlled model engine applications with a typical voltage of 1.5 volts, the clearance between the core body 20 and the plug body 11 may be small, e.g., within the range of several thousandths of an inch. It is contemplated for applications in full size motor vehicles utilizing higher voltages that the flange portion 22 of the core body 20 will be sufficiently spaced from the side wall 12 of the plug body 11 to prevent arcing therebetween.

The plug body 11 and the core body 20 serve as first and second electrodes, respectively, to supply an electric current through heater means 29 electrically connected to the first and second electrodes, 11, 20. The heater means 29 is preferably of a resister-type which generates heat when electricity is passed therethrough by the first and second electrodes 11, 20. As shown in FIG. 1, the heater means 29 is preferably a heater coil 29 located in the heater area 19" within the extension portion 19 and is electrically connected to both a lower tip 24 of the lower post portion 23 of the core body 20, and the extension portion 19. It is notable that the heater means 29 may have various different embodiments not exclusive to the heater coil 29 shown in FIG. 1. The heater means; 29 is preferably composed of a metallic resister-type material, and preferably, when used in model engine applications, a platinum, ridium and rhodium alloy is utilized. Alternatively, it is also known and contemplated to construct the heat-generating element from a non-metallic resister-type material, such as a ceramic, when utilized for full-sized engine applications.

Figure 2:
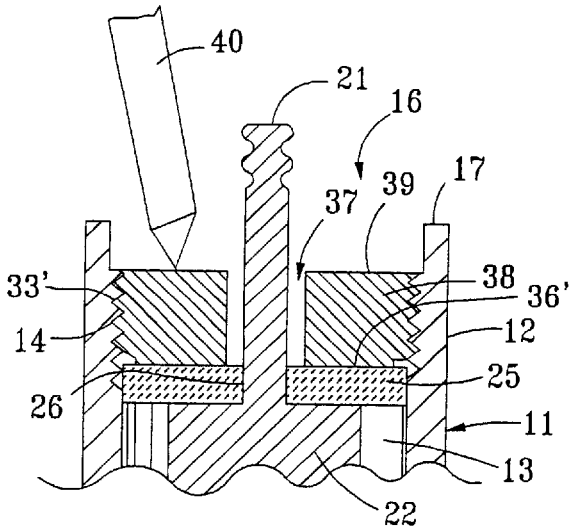
FIG. 2 is a cross-sectional view of the upper portion of the glow plug construction, illustrating the truncating step of the bolt fastener with a cutting tool.
Figure 3:
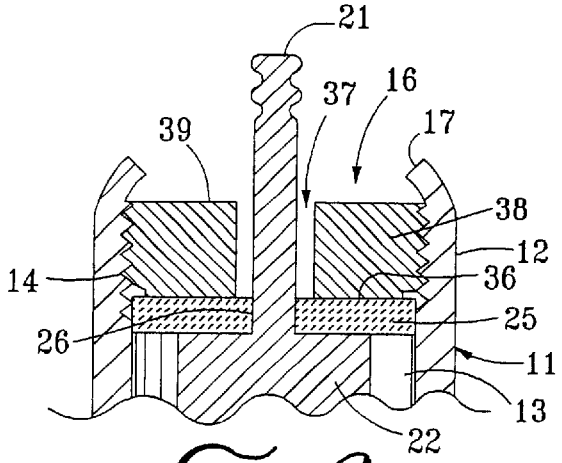
FIG. 3 is a cross-sectional view of the upper portion of the glow plug construction, similar to FIG. 2, subsequent to crimping the upper rim.

As can be seen in FIGS. 2 and 3, a nut 38 is threadedly secured in the plug bore 13 at the open upper end 16 in a manner and method to be discussed in detail below. The nut 38 has an externally-threaded sidewall 33' adapted to engage the threaded portion 14 of the plug bore 16, and which extends between a top surface 39 and an opposing bottom surface 36 of the nut 38. Furthermore, a nut bore 37 extends through the nut 38 to connect the top surface 39 and the bottom surface 36. As shown in FIGS. 2 and 3, the post portion 21 non-tactually extends through the nut bore 37, and the bottom surface 36 abuts against the upper insulating support element 25. It is notable that the threaded engagement of the threaded sidewall 33' of the nut 38 and the threaded portion 14 of the plug bore 13 provides the abutment force necessary to clamp the upper and lower insulating support elements 25 and 27, respectively, and the flange portion 22 of the core body 20 against the shelf portion 15 of the plug body 11 (see discussion below). Moreover, as can be seen in FIG. 3, the upper rim 17 of the open upper end 16 of the plug body 11 is crimped in a radially inward direction over the top surface 39 of the nut 38. While the threaded engagement of the nut 38 with the threaded portion 14 of the plug body 11 is generally sufficient to permanently secure the nut 38 therein, the crimp formation provides an additional measure of security to prevent unexpected exiting of the nut 38 from the plug bore 13. It is notable here that the crimped upper rim 17 need not contact the top surface 39 because the crimp is not intended to provide the retaining and/or sealing force. That function is substantially provided by the threaded position of the nut 38.

Figure 4:
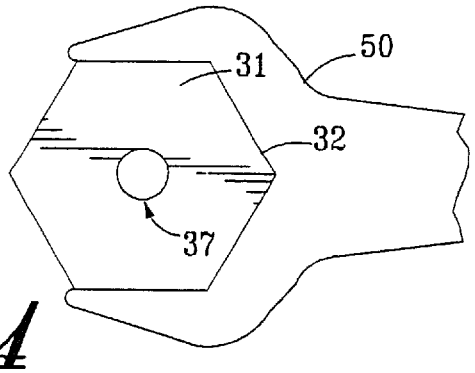
FIG. 4 is a top view of the head portion of the bolt fastener shown engaged by a wrench.

The present invention further concerns a method for assembling the glow plug construction 10 such that the nut 38 may be threadedly positioned sufficiently deep in the plug bore 13 to exert the abutment force necessary, as discussed above. First, a partially-assembled glow plug construction is provided having the core body 20 positioned within the plug bore 13 of the plug body 11, and separated and supported against the plug body 11 by means of the upper and lower insulating support elements 25 and 27. A bolt fastener, generally indicated at reference character 30, is separately provided having a head portion 31 and a threaded shank 33. The threaded shank 33 has a top end 34 connected to the head portion 31, and a bottom end 35 with a bottom surface 36. The head portion 31 is preferably adapted to engage a torquing tool 50 (FIG. 4), which is used to engage and rotate the head portion 31. As can be seen in FIGS. 1 and 4, the head portion 31 is preferably a hexagonal configuration with six contact surfaces 32. As can be seen in FIG. 1, the threaded shank 33 is adapted to engage the threaded portion 14 adjacent the upper rim 17 of the plug bore 13. Additionally, the bolt fastener 30 has a fastener bore 37 which extends from the bottom surface 36 of the threaded shank 33 a suitable distance into the threaded shank 33. The fastener bore 37 is used to create the nut bore 37 (FIGS. 2 and 3) after the truncating step discussed below. It is notable that the bolt fastener 30 is preferably composed of a metallic material, such as brass, which may be easily machined using conventional manufacturing methods.

The bolt fastener 30 is threadedly secured into the open upper end 16 of the plug body 11 by inserting the upper post portion 21 of the core body 20 into the fastener bore 37 and rotating the head portion 31 to cause engagement of the threaded shank 33 with the threaded portion 14 of the plug bore 13. It is notable that while the head portion 31 of the bolt fastener 30 may be rotated manually, i.e., by using one's hands, a torquing tool 50 shown in FIG. 5 may alternatively be used. Preferably, where the large head 31 has a hexagonal configuration, as shown in FIGS. 1 and 4, a suitable torquing tool, such as a wrench, may be utilized.

The threaded shank portion 33 of the bolt fastener 30 is continuously rotated until the bottom surface 36 of the threaded shank 33 abuts the upper insulating support element 25. Consequently, the upper and lower insulating support elements 25, 27, and the flange portion 22, of the core body 20, are clamped between the bottom surface 36 and the shelf portion 15 of the plug bore 13. Thus, threadedly securing the nut 38 further into the plug bore 13 by torquing the head portion 31 will increase the abutment force exerted, and thereby also provide a more effective seal at the upper and lower insulating support elements 25, 27. In this manner, internal combustion pressures and gases are effectively prevented from escaping through the glow plug construction 10.

Next, as can be seen in FIG. 2, the bolt fastener 30 is truncated, or cropped, so that only a truncated portion 38 of the threaded shank 33 remains in the plug bore 13. It is notable that the resulting truncated portion 38 is the nut 38 of FIG. 2 and 3. As shown in FIG. 2, a conventional cutting tool 40, known in the relevant machining and manufacturing arts, is preferably utilized to remove the head portion 31. Furthermore, and preferably, the upper portion of the bolt fastener 30 is sufficiently truncated to produce a top surface 39 of the truncated portion 38 located below the upper rim 17 of the open upper end 16. This may also require partial removal end of a portion of the threaded shank 33 at the upper end in order to achieve the required surface level for later crimping. It is notable that while the fastener bore 37 need not extend all the way through into the head portion 30, it must extend sufficiently into the threaded shank 33 such that when the upper part of the bolt fastener 30 is truncated, the resulting nut bore 37 (FIGS. 2 and 3) connects thru between the top surface 39 and the bottom surface 36.

Finally, as can be seen in FIG. 3, the upper rim 17 of the plug body 11 may be crimped in a radially inward manner such that the upper rim 17 of the open upper end 16 extends over the top surface 39 of the truncated portion 38, i.e. nut. It is notable that the crimping step, and the crimp thus formed, does not provide added support to the truncated portion 38 when crimped in the manner as shown in FIG. 3. Alternatively, however, the upper rim 17 may be crimped sufficiently to contact the top surface 39 of the truncated portion 38. It is further notable that based on experiments conducted by the applicant, the threaded attachment of the truncated portion 38 in the open upper end of the plug body 11 is sufficient to prevent sudden release of the truncated portion 38 therefrom. However, crimping of the upper rim 17 may provide a secondary measure of security if such a need were to arise.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A glow plug construction for use in an internal combustion engine, said glow plug construction comprising:

a first electrode being a plug body having an open upper end with an upper rim, said open upper end leading into a plug bore having a threaded portion adjacent said open upper end and a shelf portion below said threaded portion;

a lower insulating support element positioned in said plug bore and seated on said shelf portion;

a second electrode being a core body having a flange portion positioned in said plug bore and seated on said lower insulating support element, and a post portion connected to said flange portion and partially protruding through said open upper end;

an upper insulating support element positioned in said plug bore and seated on said flange portion wherein said core body is spaced from and supported against said plug body by said upper and lower insulating support elements;

heater means electrically connected to said first and second electrodes whereby heat is generated upon electricity passing therethrough; and a nut having an externally-threaded sidewall extending between a top surface and an opposing bottom surface, and a nut bore communicating between said top and bottom surfaces, the externally-threaded sidewall of said fastener threadedly engaged with the threaded portion of said plug bore with said post portion of said core body non-tactually extending through said nut bore, and said bottom surface abutting against said upper insulating support element, whereby said upper and lower insulating support elements and said flange portion of said core body are clamped between said bottom surface and said shelf portion, and wherein the upper rim of said plug body is crimped radially inward over the top surface of said nut.

2. A glow plug assembly method comprising the steps of:

providing a partially-assembled glow plug construction comprising a plug body having an open upper end with an upper rim, said open upper end leading into a plug bore having a threaded portion adjacent said open upper end and a shelf portion below said threaded portion; a lower insulating support element positioned in said plug bore and seated on said shelf portion; a core body having a flange portion positioned in said plug bore and seated on said lower insulating support element, and a post portion connected to said flange portion and partially protruding through said open upper end; and an upper insulating support element positioned in said plug bore and seated on said flange portion wherein said core body is spaced from and supported against said plug body by said upper and lower insulating support elements;

providing a bolt fastener having a head portion, a threaded shank adapted to engage the threaded portion of said plug bore with a top end connected to said head portion and a bottom end having a bottom surface, and a fastener bore extending through said threaded shank from said bottom end;

threadedly securing the threaded shank of said bolt fastener in said plug bore by inserting the post portion of said core body into the fastener bore and rotating the head portion to cause engagement of the threaded shank with the threaded portion of said plug bore until the bottom surface of said threaded shank abuts against said upper insulating support element, whereby said upper and lower insulating support elements and said flange portion of said core body are clamped between said bottom surface and said shelf portion; and truncating said bolt fastener such that only a truncated portion of said threaded shank remains threadedly secured in said plug bore.

3. The glow plug assembly method as in claim 2, wherein the head portion of said bolt fastener is adapted to engage a torquing tool, and the step of rotating the head portion includes the step of engaging and rotating said head portion with said torquing tool.

4. The glow plug assembly method as in claim 2, wherein the step of truncating said bolt fastener produces a top surface of said truncated portion located below said upper rim of said open upper end, and further comprising the step of crimping said upper rim of said open upper end in a radially inward direction over the top surface of said truncated portion.

5. A glow plug assembly method comprising the steps of:

providing a partially-assembled glow plug construction comprising a plug body having an open upper end with an upper rim, said open upper end leading into a plug bore having a threaded portion adjacent said open upper end and a shelf portion below said threaded portion; a lower insulating support element positioned in said plug bore and seated on said shelf portion; a core body having a flange portion positioned in said plug bore and seated on said lower insulating support element, and a post portion connected to said flange portion and partially protruding through said open upper end; and an upper insulating support element positioned in said plug bore and seated on said flange portion wherein said core body is spaced from and supported against said plug body by said upper and lower insulating support elements;

providing a bolt fastener having a head portion, a threaded shank adapted to engage the threaded portion of said plug bore with a top end connected to said head portion and a bottom end having a bottom surface, and a fastener bore extending through said threaded shank from said bottom end;

providing a torquing tool adapted to engage the head portion of said bolt fastener;

threadedly securing the threaded shank of said bolt fastener in said plug bore by inserting the post portion of said core body into the fastener bore and engaging and rotating the head portion with said torquing tool to cause engagement of the threaded shank with the threaded portion of said plug bore until the bottom surface of said threaded shank abuts against said upper insulating support element, whereby said upper and lower insulating support elements and said flange portion of said core body are clamped between said bottom surface and said shelf portion; and truncating said bolt fastener such that only a truncated portion of said threaded shank remains in said plug bore.

6. The glow plug assembly method as in claim 5, wherein the step of truncating said bolt fastener produces a top surface of said threaded shank located below said upper rim of said open upper end, and further comprising the step of crimping said upper rim of said open upper end in a radially inward direction over the top surface of said truncated portion.

* * * * *